US010606292B1

(12) United States Patent
Lai

(10) Patent No.: US 10,606,292 B1
(45) Date of Patent: Mar. 31, 2020

(54) CURRENT CIRCUIT FOR PROVIDING ADJUSTABLE CONSTANT CIRCUIT

(71) Applicant: NANYA TECHNOLOGY CORPORATION, New Taipei (TW)

(72) Inventor: Chun-Chi Lai, Taoyuan (TW)

(73) Assignee: Nanya Technology Corporation, New Taipei (TW)

( * ) Notice: Subject to any disclaimer, the term of this patent is extended or adjusted under 35 U.S.C. 154(b) by 0 days.

(21) Appl. No.: 16/250,689

(22) Filed: Jan. 17, 2019

Related U.S. Application Data

(60) Provisional application No. 62/770,949, filed on Nov. 23, 2018.

(51) Int. Cl.

| | |
|---|---|
| ***G05F 1/46*** | (2006.01) |
| ***G05F 3/26*** | (2006.01) |
| ***G05F 1/59*** | (2006.01) |
| ***G05F 1/575*** | (2006.01) |

(52) U.S. Cl.
CPC ..... *G05F 1/468* (2013.01); *G05F 1/461* (2013.01); *G05F 1/575* (2013.01); *G05F 1/59* (2013.01); *G05F 3/262* (2013.01)

(58) Field of Classification Search
CPC ... G05F 3/24; G05F 3/26; G05F 3/262; G05F 1/468; G05F 1/575; G05F 1/59; G05F 1/461
USPC ..... 323/312–317
See application file for complete search history.

(56) References Cited

U.S. PATENT DOCUMENTS

| | | | | |
|---|---|---|---|---|
| 6,531,911 | B1 * | 3/2003 | Hsu | G01K 7/015 257/E23.08 |
| 6,876,250 | B2 | 4/2005 | Hsu | |
| 7,789,558 | B2 * | 9/2010 | Yoshida | G05F 3/30 323/313 |
| 8,698,479 | B2 * | 4/2014 | Tung | G05F 3/30 323/313 |
| 2017/0227975 | A1 * | 8/2017 | Chu | G05F 3/30 |

(Continued)

FOREIGN PATENT DOCUMENTS

| | | |
|---|---|---|
| TW | I337694 | 2/2011 |
| TW | 201433169 A | 8/2014 |

(Continued)

OTHER PUBLICATIONS

Office Action dated Aug. 12, 2019 in corresponding TW Application 108105738 with English statement of relevance, 10 pages.

*Primary Examiner* — Alex Torres-Rivera
(74) *Attorney, Agent, or Firm* — Muncy, Geissler, Olds & Lowe, P.C.

(57) ABSTRACT

The present disclosure provides a current circuit. The current circuit includes a bandgap reference circuit, a plurality of current mirror circuits and a control circuit. The bandgap reference circuit is configured to provide a first current, wherein the first current is based on a reference voltage signal and is independent of temperature. The plurality of current mirror circuits are coupled to the bandgap reference circuit to receive the reference voltage signal, and the current mirror circuits are configured to provide a plurality of mirror currents based on the reference voltage signal provided by the bandgap reference circuit. The control circuit is configured to control a current flow from the plurality of current mirror circuits.

15 Claims, 4 Drawing Sheets

(56) References Cited

U.S. PATENT DOCUMENTS

| | | | | |
|---|---|---|---|---|
| 2018/0095491 | A1* | 4/2018 | Lacy | G05F 3/262 |
| 2018/0284820 | A1 | 10/2018 | Chu et al. | |

FOREIGN PATENT DOCUMENTS

| | | | |
|---|---|---|---|
| TW | 201621509 | A | 6/2016 |
| TW | 201626132 | A | 7/2016 |
| TW | I556080 | B | 11/2016 |
| TW | I608325 | B | 12/2017 |
| TW | 201838340 | A | 10/2018 |

* cited by examiner

CURRENT CIRCUIT FOR PROVIDING ADJUSTABLE CONSTANT CIRCUIT

PRIORITY CLAIM AND CROSS-REFERENCE

This application claims the priority benefit of U.S. provisional patent application No. 62/770,949, filed on Nov. 23, 2018. The entirety of the above-mentioned patent application is hereby incorporated by reference herein and made a part of this specification.

TECHNICAL FIELD

The present disclosure relates to an integrated circuit, and more particularly, to a current circuit for providing an adjustable constant current.

DISCUSSION OF THE BACKGROUND

In an integrated circuit, it is common for the characteristic of an electrical component, such as a resistor, to vary with temperature. When integrated circuits are designed for use with a constant current input or a biasing current signal, a constant current source is employed.

Constant current sources are regularly employed in integrated circuits such as biasing input buffer circuits, delay circuits, and/or oscillator circuits. Traditional constant current sources employ a bandgap reference circuit using multiple amplifiers. The multiple amplifiers, however, consume substantial power and occupy significant space in the circuit. Also, there may be a need to provide adjusted constant currents for different devices.

This Discussion of the Background section is for background information only. The statements in this Discussion of the Background are not an admission that the subject matter disclosed in this section constitutes a prior art to the present disclosure, and no part of this section may be used as an admission that any part of this application, including this Discussion of the Background section, constitutes prior art to the present disclosure.

SUMMARY

One aspect of the present disclosure provides a current circuit. The current circuit comprises a bandgap reference circuit configured to provide a first current that is based on a reference voltage signal and is independent of temperature; a plurality of current mirror circuits coupled to the bandgap reference circuit to receive the reference voltage signal, the plurality of current mirror circuits being configured to provide a plurality of mirror currents based on the reference voltage signal from the bandgap reference circuit; and a control circuit configured to control a current flow from the plurality of current mirror circuits.

Another aspect of the present disclosure provides a current circuit. The current circuit comprises a bandgap reference circuit configured to provide a first current, wherein the first current is based on a reference voltage signal and is independent of temperature, the bandgap reference circuit includes an amplifier having first and second input nodes and an output node providing the reference voltage signal, and the output node of the amplifier is coupled to the first and second input nodes of the amplifier to form a feedback path; a plurality of current mirror circuits coupled to the bandgap reference circuit to receive the reference voltage signal, the current mirror circuits being configured to provide a plurality of mirror currents based on the reference voltage signal from the bandgap reference circuit; and a programmable switching device coupled to the plurality of current mirror circuits configured to selectively output the plurality of mirror currents.

With the above-mentioned configurations of the current circuit, a constant current is provided and may be adjusted according to requirements.

The foregoing has outlined rather broadly the features and technical advantages of the present disclosure in order that the detailed description of the disclosure that follows may be better understood. Additional features and technical advantages of the disclosure are described hereinafter, and form the subject of the claims of the disclosure. It should be appreciated by those skilled in the art that the concepts and specific embodiments disclosed may be utilized as a basis for modifying or designing other structures, or processes, for carrying out the purposes of the present disclosure. It should also be realized by those skilled in the art that such equivalent constructions do not depart from the spirit or scope of the disclosure as set forth in the appended claims.

BRIEF DESCRIPTION OF THE DRAWINGS

A more complete understanding of the present disclosure may be derived by referring to the detailed description and claims. The disclosure should also be understood to be connected to the figures' reference numbers, which refer to similar elements throughout the description.

DETAILED DESCRIPTION

Figure 1:
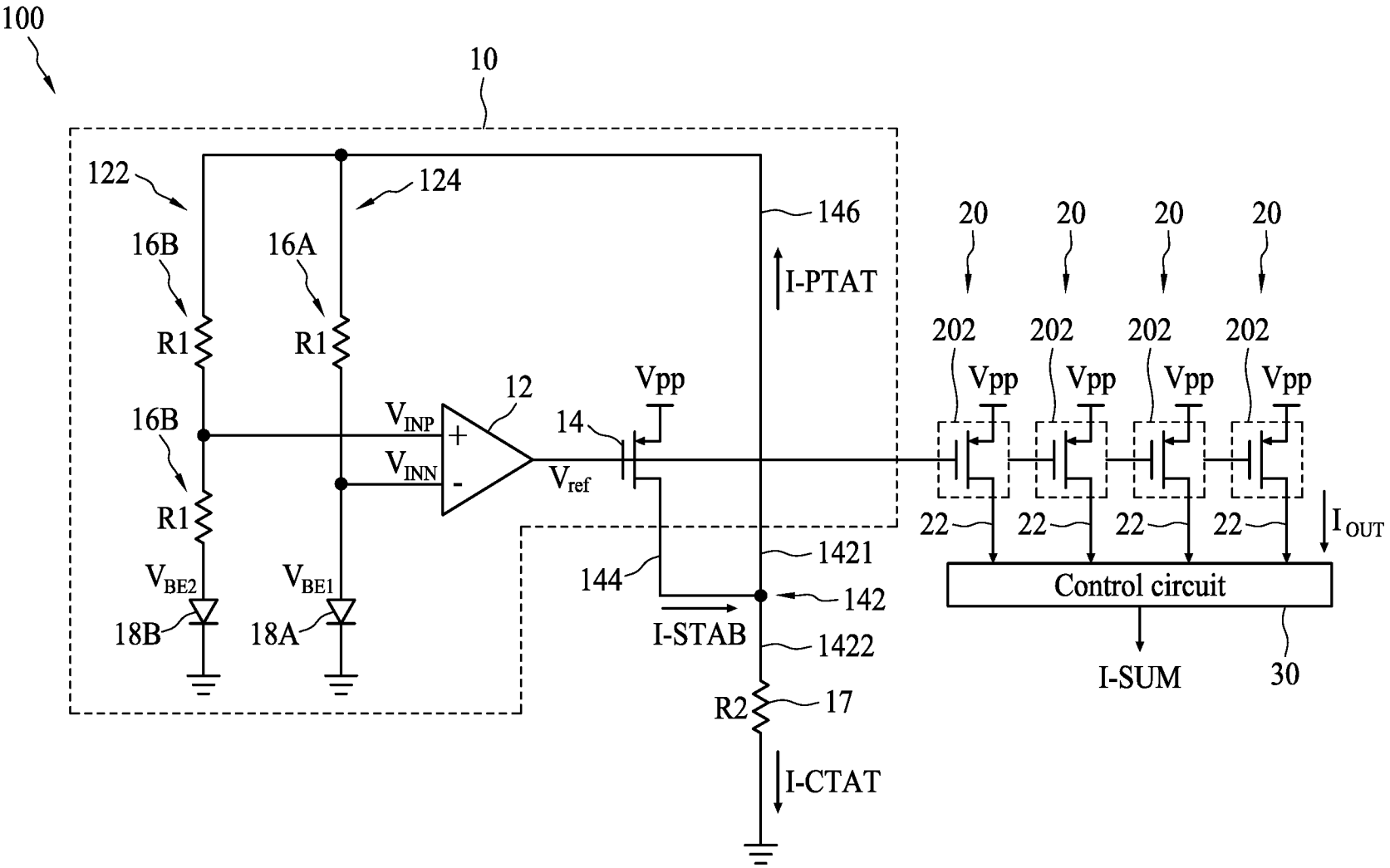
FIG. 1 is a circuit diagram illustrating a current circuit in accordance with some embodiments of the present disclosure.

Embodiments, or examples, of the disclosure illustrated in the drawings are now described using specific language. It shall be understood that no limitation of the scope of the disclosure is hereby intended. Any alteration or modification of the described embodiments, and any further applications of principles described in this document, are to be considered as normally occurring to one of ordinary skill in the art to which the disclosure relates. Reference numerals may be repeated throughout the embodiments, but this does not necessarily mean that feature(s) of one embodiment apply to another embodiment, even if they share the same reference numeral.

It shall be understood that, although the terms first, second, third, etc. may be used herein to describe various elements, components, regions, layers or sections, these elements, components, regions, layers or sections are not limited by these terms. Rather, these terms are merely used to distinguish one element, component, region, layer or section from another element, component, region, layer or section. Thus, a first element, component, region, layer or section discussed below could be termed a second element, component, region, layer or section without departing from the teachings of the present inventive concept.

The terminology used herein is for the purpose of describing particular example embodiments only and is not intended to be limited to the present inventive concept. As used herein, the singular forms "a," "an" and "the" are intended to include the plural forms as well, unless the context clearly indicates otherwise. It shall be further understood that the terms "comprises" and "comprising," when used in this specification, point out the presence of stated features, integers, steps, operations, elements, or components, but do not preclude the presence or addition of one or more other features, integers, steps, operations, elements, components, or groups thereof.

FIG. 1 is a circuit diagram illustrating a current circuit 100 in accordance with some embodiments of the present disclosure. The current circuit 100 generally includes a bandgap reference circuit 10, a plurality of current mirror circuits 20 and a control circuit 30. The plurality of current mirror circuits 20 are p-type field effect transistors (pFET) as illustrated in the embodiment of FIG. 1; however, it will be appreciated that other examples of current mirror circuit 20 including circuits different from those shown in FIG. 1 may be used in other embodiments of the disclosure.

The bandgap reference circuit 10 provides a reference voltage (Vref). In some embodiments, the bandgap reference circuit 10 may provide a reference voltage of 1.25 V. In the embodiment of FIG. 1, the bandgap reference circuit 10 includes an amplifier 12, an output transistor 14, a plurality of resistors 16A and 16B, and a plurality of diodes 18A and 18B. The plurality of diodes 18A and 18B (resistive elements) may exhibit a temperature dependency, such as having a current that varies based on the temperature. In some embodiments, the plurality of diodes 18A and 18B exhibit a current that increases with increasing temperature. In other words, resistance values of the plurality of diodes 18A and 18B may represent negative temperature coefficients. In various embodiments, the amplifier 12 may be an operational transconductance amplifier (OTA) or an operational amplifier. The amplifier 12 includes a non-inverting (+) input node, an inverting (−) input node, and an output node. The amplifier 12 is configured to provide the reference voltage (Vref) signal based on the inputs provided to the non-inverting input node and the inverting input node. Those skilled in the art will appreciate that embodiments implemented with an operational amplifier may further include compensation components, such as capacitors. The output transistor 14 is illustrated as a pFET in the embodiment of FIG. 1, but other transistors may be used in other embodiments.

In the depicted embodiment, the output node of the amplifier 12 is coupled to the gate of the output transistor 14, the source of the output transistor 14 is coupled to a supply voltage Vpp, and the drain of the output transistor 14 is coupled a current output node 142 and provides an output signal 144. In the depicted embodiment, a first branch 1421 of the current output node 142 provides a feedback signal 146, which may carry a constant voltage of 1.25 V, and a current (I-PTAT) that is proportional to the absolute temperature. Those skilled in the art will appreciate that I-PTAT increases as temperature increases, as discussed in further detail below with respect to FIG. 2.

The current, I-PTAT, may be determined based on components to which the feedback signal 146 is provided. In the depicted embodiment, the feedback signal 146 is provided to a positive feedback loop 122 (a first current path) and a negative feedback loop 124 (a second current path). The positive feedback loop 122 includes two resistors 16B and a diode 18B coupled in series to the ground. The resistor 16B may have an associated resistance, R1, which may represent a positive temperature coefficient. The non-inverting input node (+) of the amplifier 12 is coupled to a node between the two series-connected resistors 16B in the positive feedback loop 122 and receives an input voltage $V_{INP}$. The negative feedback loop 124 includes a resistor 16A, having a resistance R1, and a diode 18A coupled in series to the ground. The inverting input (−) of the amplifier 12 is coupled to a node between the resistor 16B and the diode 18B in the negative feedback loop 124 and receives an input voltage $V_{INN}$. The current, I-PTAT, of the feedback signal 146 may be determined based on Ohm's Law, $$\text{I-PTAT} = \frac{2 \times \Delta V}{R_1},$$

where ΔV is the difference between VBE1 and VBE2, which are voltages of diodes 18A and 18B, respectively, and depends on the properties of the diodes 18A and 18B. For example, as previously discussed, the diodes 18A and 18B may exhibit a current that increases with increasing temperature. As a result, ΔV may be directly proportional to temperature (e.g., $V \propto kT/q$, where k is Boltzmann's constant, T is the absolute temperature, and q is the magnitude of the electron charge). Therefore, I-PTAT may also be directly proportional to the temperature (as indicated by the acronym PTAT). Those skilled in the art will appreciate that the bandgap reference circuit 10 depicted in FIG. 1 is provided merely as an example, and other bandgap reference circuits may be used without departing from the scope of this disclosure.

A second branch 1422 of the node 142 is coupled to the ground through a resistor 17 having a resistance, R2, which may represent a positive temperature coefficient. The second branch 1422 of the node 142 may provide a current (I-CTAT) that is complementary to the absolute temperature. The current, I-CTAT, is equal to the voltage at the node 142 (e.g., 1.25 V) divided by the resistance R2 of the resistor 17 (e.g., R2). In various embodiments, the resistance R2 of the resistor 17 may be selected such that the current, I-CTAT, has a temperature dependence opposite to that of the current I-PTAT. For example, I-PTAT may increase linearly with temperature (e.g., I-PTAT increases by 0.1 μA per 100K). In such case, the resistor 17 is selected such that the current through the resistor 17, I-CTAT, decreases at the same rate (e.g., I-CTAT decreases by 0.1 μA per 100K). In one embodiment, the resistor 17 may have a resistance R2=225 kΩ. By configuring the currents I-PTAT and I-CTAT to have equal and opposite temperature dependencies, the current of the output signal 144 (the output current I-STAB) is configured to remain constant over varying temperatures. That is, as the temperature increases, the current through the feedback signal 146 increases and the current through the second branch 1422 decreases at the same rate. Therefore, because the sum of I-PTAT and I-CTAT (e.g., the total current leaving the node 142) is constant and independent of temperature, the current of the node 142 (e.g., I-STAB) is also constant and independent of temperature.

The output node of the amplifier 12 may also be further coupled to the plurality of current mirror circuits 20. In some embodiments, each of the current mirror circuits 20 may have a current mirror transistor 202 with a source coupled to the supply voltage, Vpp, and each current mirror circuit 20 may provide an output current 22 ($I_{OUT}$) at the drain, wherein the output current 22 is the mirror current of I-STAB. In the depicted embodiment, the drain of the current mirror transistor 202 is coupled to a control circuit 30. As such, the output current of the current mirror circuit 20 can be controlled by the control circuit 30 to adjust an output current I-SUM. In some embodiments, the control circuit 30 includes a plurality of switch circuits. In some embodiments, the switch circuit is implemented by the transistor, which is configured to selectively turn on to output the mirror currents from the respective current mirror circuits 20 in order to adjust the output current I-SUM. For example, if it is desirable to have the output current I-SUM N times greater than the mirror current of I-STAB, then N number of current mirror circuits 20 and corresponding switch circuits in the control circuit 30 are turned on. In some embodiments, the current mirror transistors 202 of the current mirror circuits 20 and the output transistor 14 may be matched (e.g., have the same electrical characteristics and performance).

In other embodiments, the channel aspect ratio (a ratio of the channel width (W) to the channel length (L)) of the current mirror transistors 202 may be adjusted relative to that of the output transistor 14 to compensate for differences between the current of the output signal 22 and the output signal 144. In some embodiments, the channel aspect ratio of the current mirror circuit 20 may be some arbitrary number of times greater or less than that of the output transistor 14 in order to obtain a different output current I-SUM. By selecting the resistance (R2) of the resistor 17 to create the current (I-CTAT) that complements the temperature variability of the current (I-PTAT), and mirroring the current (I-STAB) of the output signal 144 to the output current (I-SUM) of the output signal 22, the current circuit 100 provides a temperature-independent, constant current output which may be provided to any other component or circuit that requires a constant current source.

Figure 2:
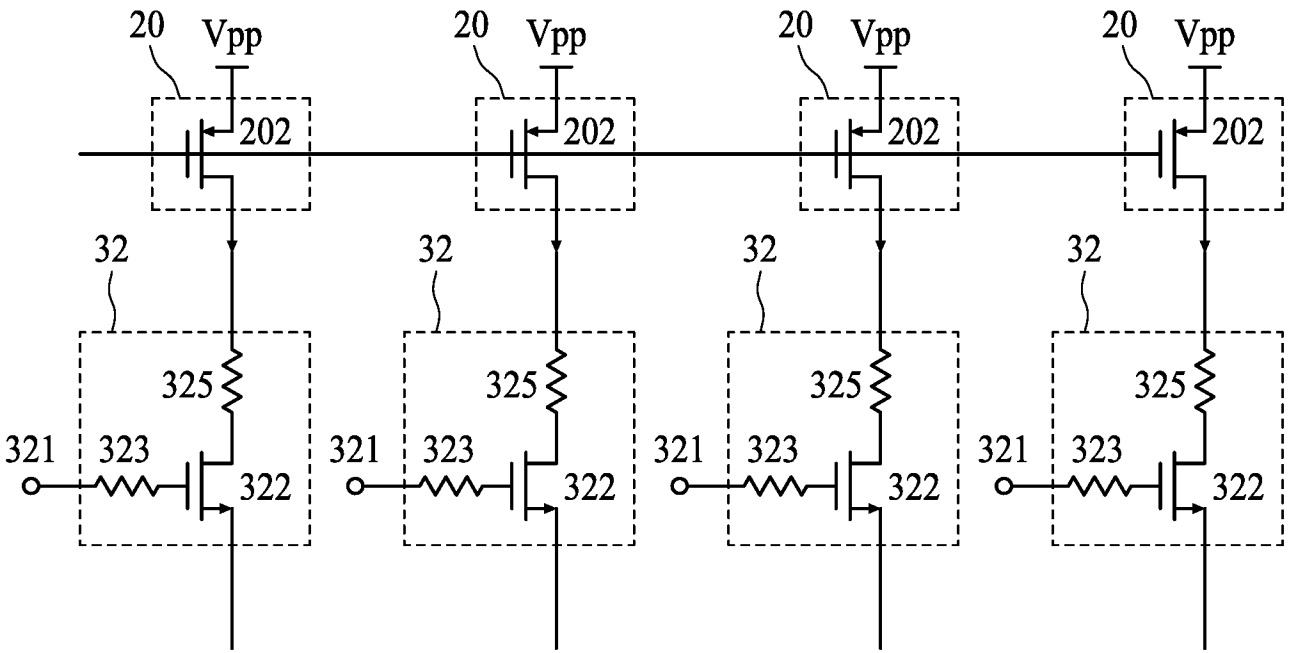
FIG. 2 is a circuit diagram illustrating a programmable switching device of the current circuit in accordance with some embodiments of the present disclosure.

FIG. 2 is a circuit diagram illustrating the control circuit 30 of the current circuit 100 in accordance with some embodiments of the present disclosure. The control circuit 30 includes a plurality of switch circuits 32 coupled to the current mirror circuits 20, respectively. In some embodiments, each of the switch circuits 32 includes a switch transistor 322 having a gate coupled to a control node 321 through an input resistor 323 and a drain coupled to the drain of the corresponding current mirror transistor 202 of the current mirror circuit 20 through a load resistor 325. Therefore, when a low signal is applied to the control node 321, the switch transistor 322 operates in a cut-off mode so that no current flows through the drain-source path of the switch transistor 322, i.e., no current flows from the corresponding current mirror transistor 202 to the output current I-SUM. In contrast, when a high signal is applied to the control node 321, the switch transistor 322 operates in a saturated mode so that current flows through the drain-source path of the switch transistor 322, and current flows from the corresponding current mirror transistor 202 to the output current I-SUM. In some embodiments, the signal applied to the control node 321 of the switch transistor 332 is programmable.

Figure 3:
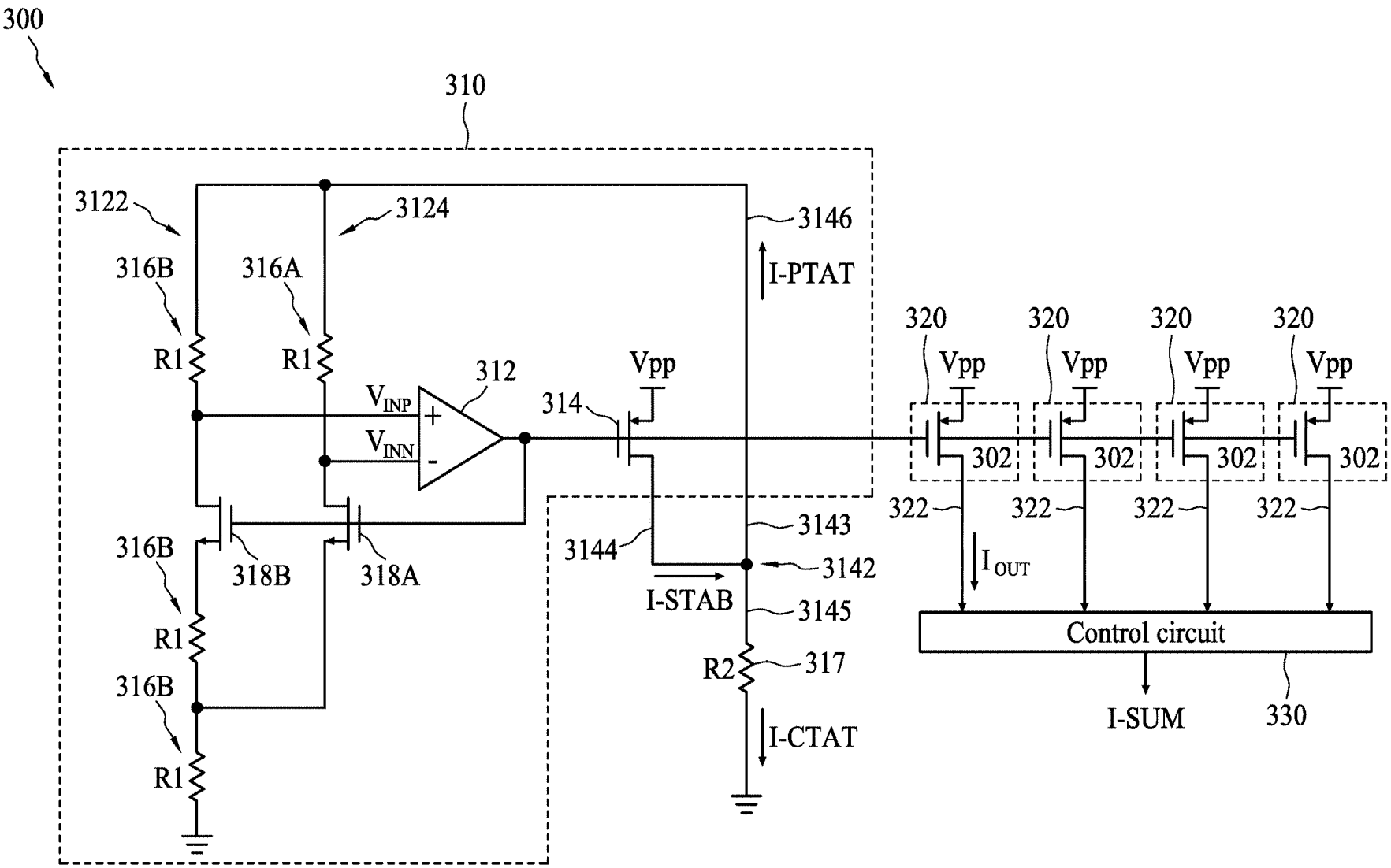
FIG. 3 is a circuit diagram illustrating a current circuit in accordance with some embodiments of the present disclosure.

FIG. 3 is a schematic diagram of a current circuit 300 in accordance with some embodiments of the present disclosure. The current circuit 300 includes a bandgap reference circuit 310, a plurality of current mirror circuits 320, and a control circuit 330. The bandgap reference circuit 310 includes an amplifier 312, an output transistor 314, a plurality of resistors 316A, 316B having a resistance (R1), and a plurality of transistors 318A, 318B. In the depicted embodiment, the amplifier 312 provides a signal to the output transistor 314 and the transistors 318A, 318B. The output transistor 314 receives a supply voltage (Vpp), and provides an output signal 3144 to a node 3142 based on the output signal of the amplifier 312 and the supply voltage Vpp. The node 3142 may be coupled to a first branch 3143 and a second branch 3145. The first branch 3143 may provide a current (I-PTAT) carrying a feedback signal 3146, wherein the current is proportional to the absolute temperature.

The feedback signal 3146 may be provided to the resistor 316B in a positive feedback loop 3122 and the resistor 316A in a negative feedback loop 3124. The positive feedback loop 3122 may include a resistor 316B coupled in series to the transistor 318B, and two additional resistors 316B coupled to the ground. The positive feedback loop 3122 may provide a signal $V_{INP}$ to a non-inverting input (+) of the amplifier 312. The negative feedback loop 3124 includes the resistor 316A coupled in series to the transistor 318A. The negative feedback loop 3124 may provide a signal V to an inverting input (−) of the amplifier 312.

The second branch 3145 may include a resistor 317 having a resistance R2 coupled to the ground. The resistance R2 may be selected such that the current, I-CTAT, through the resistor 317 is complementary to absolute temperature. That is, the current I-CTAT through the resistor 317 has temperature dependency that is equal in magnitude and opposite in direction to the temperature dependency of the feedback signal 3146. Because the currents I-PTAT and I-CTAT through the first branch 3143 and second branch 3145 have equal and opposite temperature dependency, the current I-STAB through the output signal 3144 may exhibit reduced temperature dependency.

The output signal of the amplifier 312 may also be further coupled to the plurality of current mirror circuits 320. In some embodiments, each of the current mirror circuits 320 may have a current mirror transistor 302 with a source coupled to the supply voltage (Vpp), and each current mirror circuit 320 provides an output signal 322 at the drain having a current that is the mirror current of I-STAB. In the depicted embodiment, the drain of each of the current mirror transistors 302 is coupled to the control circuit 330. As such, the output current of the current mirror circuit 320 is controlled by the control circuit 30 to adjust an output current I-SUM. In some embodiments, the control circuit 330 includes a plurality of switch circuits coupled to the current mirror circuits 320, respectively, in order to adjust the output current I-SUM. For example, if it is desirable to have the output current I-SUM N times greater than the mirror current of I-STAB, then N number of current mirror circuits 320 and corresponding switch circuits are turned on.

In some embodiments, the current mirror transistor 302 may have a channel aspect ratio similar to that of the output transistor 314, and each of the current mirror circuits 320 may provide an output signal 322 having a current I-SUM. In some embodiments, the channel aspect ratio of the current mirror circuit 320 may be an arbitrary number of times greater or less than that of the output transistor 314 in order to obtain a different output current I-SUM. In some embodiments, the current of the output signal 322 may mirror the current of the output signal 3144. That is, the current I-SUM may have reduced temperature dependency compared to traditional current sources. In other embodiments, the transistor in the current mirror circuit 320 may have a channel aspect ratio that is adjusted relative to the channel aspect ratio of the output transistor 314 such that the current of the output signal 322 mirrors the current of the output signal 3144. As described above with respect to FIG. 1, the output signal 322 may be provided to any of a number of circuits including input buffers, oscillator circuits, delay circuits, or any other type of circuit that may benefit from a signal having reduced temperature dependence.

Figure 4:
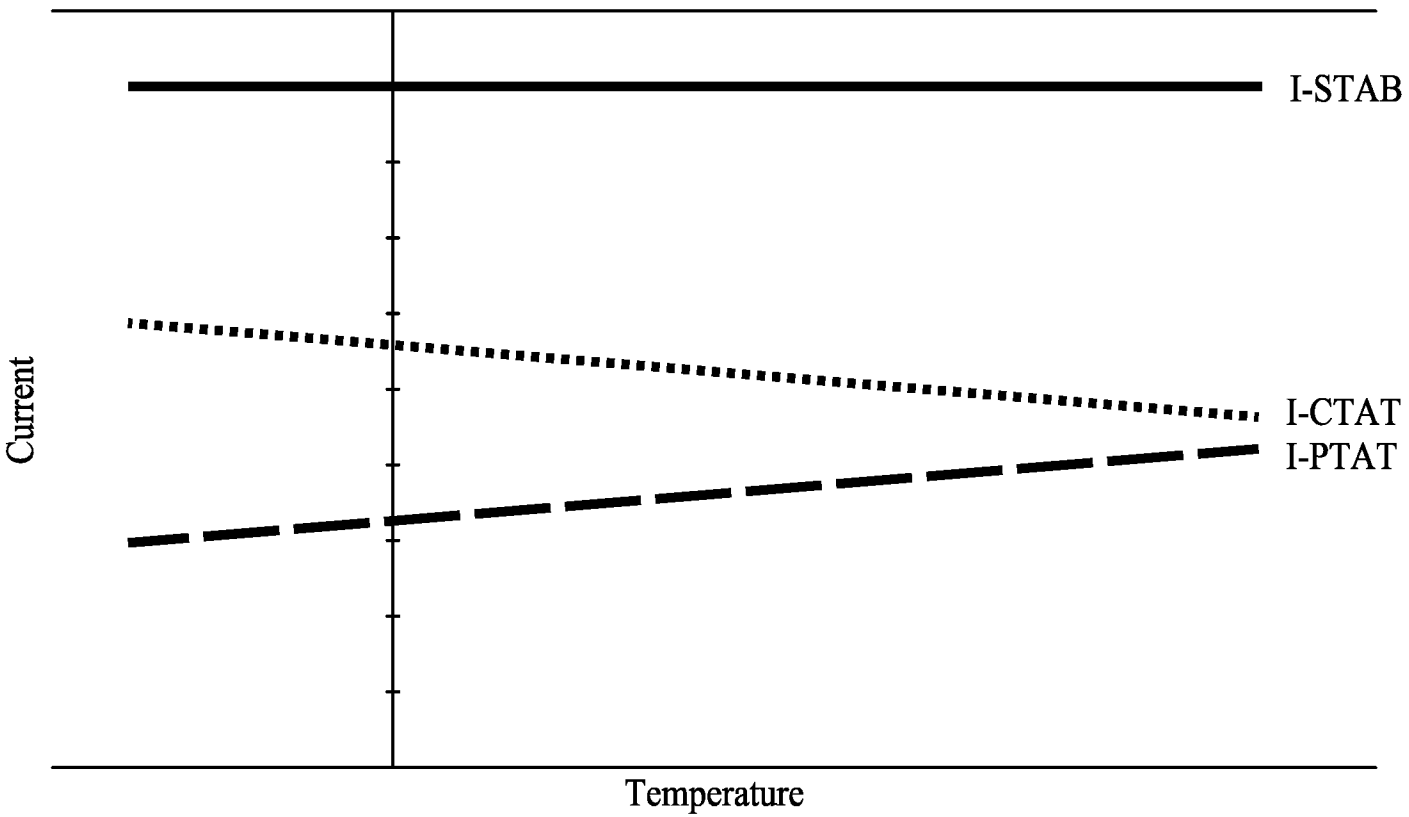
FIG. 4 is a graph depicting the output currents of a temperature-independent, constant current source in accordance with an embodiment of the present disclosure.

FIG. 4 is a graph depicting the output currents of a temperature-independent, constant current circuit in accordance with some embodiments of the present disclosure. The graph shows temperature on the horizontal axis and current on the vertical axis. As described above, the current I-PTAT is proportionally related to temperature, such that the current increases as temperature increases. The current I-CTAT is inversely proportionally related to temperature, such that the current decreases as temperature increases. The temperature dependencies of I-PTAT and I-CTAT are equal and opposite such that when I-PTAT and I-CTAT are added together, a temperature-independent, constant current, I-STAB, is produced. The temperature-independent, constant current, I-STAB, may be provided to any electrical component that benefits from the use of a temperature-independent, constant current.

In conclusion, in some embodiments of the present disclosure, with the above-mentioned configurations of the current circuit, a constant current is provided and may be adjusted based on requirements.

One aspect of the present disclosure provides a current circuit. The current circuit comprises a bandgap reference circuit configured to provide a first current, wherein the first current is based on a reference voltage signal and is independent of temperature; a plurality of current mirror circuits coupled to the bandgap reference circuit to receive the reference voltage signal, the plurality of current mirror circuits being configured to provide a plurality of mirror currents based on the reference voltage signal from the bandgap reference circuit; and a control circuit configured to control a current flow from the plurality of current mirror circuits.

Another aspect of the present disclosure provides a current circuit. The current circuit comprises a bandgap reference circuit configured to provide a first current, wherein the first current is based on a reference voltage signal and is independent of temperature, the bandgap reference circuit includes an amplifier having first and second input nodes and an output node providing the reference voltage signal, and the output node of the amplifier is coupled to the first and second input nodes of the amplifier to form a feedback path; a plurality of current mirror circuits coupled to the bandgap reference circuit to receive the reference voltage signal, the current mirror circuits being configured to provide a plurality of mirror currents based on the reference voltage signal from the bandgap reference circuit; and a programmable switching device coupled to the plurality of current mirror circuits configured to selectively output the plurality of mirror currents.

Although the present disclosure and its advantages have been described in detail, it should be understood that various changes, substitutions and alterations can be made herein without departing from the spirit and scope of the disclosure as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, and composition of matter, means, methods and steps described in the specification. As one of ordinary skill in the art will readily appreciate from the present disclosure, processes, machines, manufacture, compositions of matter, means, methods or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods and steps.

What is claimed is:

1. A current circuit, comprising:

a bandgap reference circuit configured to provide a first current, wherein the first current is based on a reference voltage signal and is independent of temperature;

a plurality of current mirror circuits coupled to the bandgap reference circuit to receive the reference voltage signal, the plurality of current mirror circuits being configured to provide a plurality of mirror currents based on the reference voltage signal from the bandgap reference circuit; and a control circuit configured to control a current flow from the plurality of current mirror circuits, the control circuit comprising a plurality of switch circuits coupled to the plurality of current mirror circuits, respectively, wherein at least one of the plurality of switch circuits comprises a switch transistor coupled to one of the plurality of current mirror circuits, and the switch transistor includes a gate coupled to a control node through an input resistor and a drain coupled to the corresponding current mirror circuit through a load resistor.

2. The current circuit of claim 1, wherein at least one of the plurality of current mirror circuits comprises a current mirror transistor having a gate configured to receive the reference voltage signal.

3. The current circuit of claim 1, wherein the plurality of current mirror circuits comprises a first current mirror transistor and a second current mirror transistor, the first current mirror transistor has a first channel aspect ratio, and the second current mirror transistor has a second channel aspect ratio different from the first channel aspect ratio.

4. The current circuit of claim 1, wherein the bandgap reference circuit comprises an amplifier having first and second input nodes and an output node providing the reference voltage signal, and the output node of the amplifier is coupled to the first and second input nodes of the amplifier to form a feedback path.

5. The current circuit of claim 4, wherein the bandgap reference circuit further comprises an output transistor coupled to the output node of the amplifier and configured to provide the first current.

6. The current circuit of claim 5, wherein the first current is divided into a second current that is proportional to absolute temperature and a third current that is complementary to absolute temperature.

7. The current circuit of claim 6, wherein the third current is determined by a first resistor that represents a positive temperature coefficient.

8. The current circuit of claim 7, wherein the feedback path comprises:

a positive feedback branch coupled to the first input node of the amplifier, wherein the first input node of the amplifier represents a non-inverting input; and a negative feedback branch coupled to the second input node of the amplifier, wherein the second input node of the amplifier represents an inverting input.

9. The current circuit of claim 8, wherein the positive feedback branch includes a second resistor, a third resistor, and a first diode.

10. The current circuit of claim 9, wherein the second resistor and third resistor represent a negative temperature coefficient and have the same resistance.

11. The current circuit of claim 10, wherein the negative feedback branch comprises a fourth resistor and a second diode.

12. The current circuit of claim 11, wherein the fourth resistor represents a negative temperature coefficient and has a resistance value equal to that of the second and third resistors.

13. A current circuit, comprising:

a bandgap reference circuit configured to provide a first current, wherein the first current is based on a reference voltage signal and is independent of temperature, the bandgap reference circuit includes an amplifier having first and second input nodes and an output node providing the reference voltage signal, and the output node of the amplifier is coupled to the first and second input nodes of the amplifier to form a feedback path;

a plurality of current mirror circuits coupled to the bandgap reference circuit to receive the reference voltage signal, the current mirror circuits being configured to provide a plurality of mirror currents based on the reference voltage signal from the bandgap reference circuit; and a programmable switching device coupled to the plurality of current mirror circuits configured to selectively output the plurality of mirror currents, the programmable switching device comprising a plurality of switch circuits coupled to the plurality of current mirror circuits, respectively, wherein at least one of the plurality of switch circuits comprises a switch transistor coupled to one of the plurality of current mirror circuits, and the switch transistor includes a gate coupled to a control node through an input resistor and a drain coupled to the corresponding current mirror circuit through a load resistor.

14. The current circuit of claim 13, wherein at least one of the plurality of current mirror circuits comprises a current mirror transistor having a gate configured to receive the reference voltage signal.

15. The current circuit of claim 13, wherein the plurality of current mirror circuits comprises a first current mirror transistor and a second current mirror transistor, the first current mirror transistor has a first channel aspect ratio, and the second current mirror transistor has a second channel aspect ratio different from the first channel aspect ratio.

* * * * *